United States Patent [19]

Nakagawa et al.

[11] Patent Number: 4,784,058

[45] Date of Patent: Nov. 15, 1988

[54] PRESS CONTROL FOR MAINTAINING A LEVEL POSITION AND A UNIFORM PRESSURE ON A WORKPIECE

[75] Inventors: Noriharu Nakagawa, Neyagawa; Masanobu Kurumaji, Kobe; Kazuyuki Kijayama, Akashi; Koichi Fukushima, Kobe; Nobuo Kimura, Kobe; Satoshi Hirota, Kobe; Hiroaki Kondo, Kobe; Hiroyuki Kuwano, Akashi; Toshiaki Akita, Amagasaki; Tsutomu Sano, Kobe, all of Japan

[73] Assignee: Kabushiki Kaisha Kobe Seiko Sho, Kobe, Japan

[21] Appl. No.: 80,477

[22] Filed: Jul. 31, 1987

[30] Foreign Application Priority Data

| | | | |
|---|---|---|---|
| Aug. 13, 1986 | [JP] | Japan | 61-191128 |
| Aug. 28, 1986 | [JP] | Japan | 61-202090 |
| Jan. 8, 1987 | [JP] | Japan | 62-002071 |

[51] Int. Cl.[4] ..... B30B 15/24

[52] U.S. Cl. ..... 100/35; 100/46

[58] Field of Search ..... 100/258 A, 46, 35, 48, 100/269 R; 72/20, 21; 425/150

[56] References Cited

U.S. PATENT DOCUMENTS

| | | | |
|---|---|---|---|
| 4,148,203 | 4/1979 | Farazandeh et al. | 100/46 |
| 4,157,066 | 6/1979 | Pretty | 100/46 |

FOREIGN PATENT DOCUMENTS

| | | | |
|---|---|---|---|
| 0224098 | 12/1983 | Japan | 100/46 |
| 6030323 | 2/1985 | Japan . | |

*Primary Examiner*—Andrew M. Falik

*Attorney, Agent, or Firm*—Oblon, Fisher, Spivak, McClelland & Maier

[57] ABSTRACT

A press working control method for controlling the press working operation of a press having a pressure cylinder for applying a working pressure to a workpiece, a press slide operatively connected to the pressure cylinder and carrying a movable die, a bed fixedly mounted with a fixed die, a plurality of control cylinders supporting the press slide in a level position during the press working operation, and a press control system for carrying out the press working control method. The press control system comprises a first pressure detector for detecting the operative pressure of the pressure cylinder, quick-response control valves each for regulating the height of the control cylinder, height detectors each for detecting the height of the control cylinder, second pressure detectors each for detecting the operative pressure of the control cylinder, servovalves each for detecting the operative pressure of the control cylinder, and a control unit including a computer for deciding manipulated variables for the height and operative pressure control of the control cylinders on the basis of data obtained by the detectors. The respective heights of the control cylinders are regulated individually so that the press slide is maintained in a level position during the press working operation, while the respective operative pressure of the control cylinders are regulated so that a desired working pressure is applied to the workpiece.

10 Claims, 10 Drawing Sheets

PRESS CONTROL FOR MAINTAINING A LEVEL POSITION AND A UNIFORM PRESSURE ON A WORKPIECE

BACKGROUND OF THE INVENTION

1. Field of the Invention

The present invention relates to a press working control method and a control system for controlling the die-forming operation of a hydraulic press in die-forming a work piece such as a resin plate and, more specifically, to a press working control method and a control system for controlling a die-forming process so that the movable die is maintained in a level position and pressure is applied uniformly to the workpiece during the die-forming process.

2. Description of the Prior Art

In die-forming a workpiece such as a resin plate on a hydraulic press, it is important, for securing satisfactory reproducibility, to maintain the movable die at a high parallel accuracy and to apply pressure uniformly to the workpiece during a period from the moment of contact of the movable die with the workpiece to the completion of the die-forming process. However, the conventional press which depends on mechanical rigidity of the construction for accurate press working is unable to maintain the die at a high parallel accuracy of, for example, 0.05 mm and to maintain the working pressure acting on the workpiece at a fixed level.

An improved press working control method eliminating those drawbacks is disclosed in Japanese Patent Provisional Publication (Kokai) No. 60-30323. According to this improved press working control method, a press slide carrying a movable die is balanced accurately by balancing mechanisms provided on the bed of the press, the supporting force of each balancing mechanism, namely, load on each balancing mechanism, is detected, the detected supporting force is compared with a predetermined reference force, the lowering speed of the press slide is reduced when the detected supporting force is greater than the reference force or is increased when the supporting force is smaller than the reference force, in order to make the balancing mechanisms always exert an effective counter force on the press slide so that the press slide, hence the movable die, is supported at a high parallel accuracy and a fixed pressure is applied to the workpiece.

However, whereas the parallel accuracy is quantified by height, the dynamic parallel accuracy of the press slide is controlled on the basis of the difference between the respective speeds of the balancing mechanisms. Accordingly, the parallel accuracy of the press slide is deteriorated due to the inherent delay of the control action. Furthermore, since the respective speeds of the balancing mechanisms are reduced synchronously, the dynamic parallel accuracy of the press slide is deteriorated when the workpiece is dislocated from a correct position as shown in FIG. 11(*a*) or when the viscosity of the workpiece varies by position in the workpiece as shown in FIG. 11(*b*).

On the other hand, the ram speed is regulated to apply a fixed pressure to the workpiece. Therefore, two control loops, namely, a control loop for controlling the speed of the balancing mechanisms and a control loop for controlling the ram speed, need to be executed by a single operating means. Consequently, both the objects of the press working control method, namely, maintaining the press slide at a high parallel accuracy and applying a fixed pressure to the workpiece, interfere with each other due to the difference between the two control loops in timing.

SUMMARY OF THE INVENTION

Accordingly, it is an object of the present invention to provide a press working control method and a press control system for implementing the same, capable of controlling a press so that the press slide of the press is maintained at a high parallel accuracy and a fixed pressure is applied always to the workpiece.

To achieve the foregoing object of the invention, in one aspect of the present invention, a press control system for controlling a press so that the press slide thereof which is pressed by a pressure cylinder is maintained at a high parallel accuracy and a fixed pressure is applied always to a workpiece comprises: a plurality of control cylinders disposed on the bed of the press to support the press slide of the press; a first pressure detector provided on the pressure cylinder to detect the operative pressure of the pressure cylinder; position detectors respectively associated with the control cylinders to detect the respective heights of the control cylinders; second pressure detectors respectively provided on the control cylinders to detect the respective operative pressures of the control cylinders; a first comparing means which compares the respective heights of the control cylinders detected by the position detectors; a first manipulated variable deciding means which decides manipulated variables to be applied to the control cylinders on the basis of the result of comparison by the first comparing means; first control means which control the control cylinders according to the manipulated variables provided by the first manipulated variable deciding means; an effective pressure measuring means which measures an effective pressure from the difference between the operative pressure of the pressure cylinder detected by the first pressure detector and the total pressure of the respective operative pressures of the control cylinders detected by the second pressure detectors; a second comparing means which compares the effective pressure determined by the effective pressure measuring means and a predetermined reference pressure; a second manipulated variable deciding means which decides manipulated variables to be applied to the control cylinders, respectively, on the basis of the results of comparison by the second comparing means; and second control means which control the control cylinders according to the manipulated variables decided by the second manipulated variable deciding means.

BRIEF DESCRIPTION OF THE DRAWINGS

The above and other objects, features and advantages of the present invention will become apparent from the following description taken in conjunction with the accompanying drawings, in which:

FIG. 1(*b*) is a diagrammatic illustration of the press of FIG. 1(*a*) incorporating a press control system, in a first embodiment, according to the present invention;

DESCRIPTION OF THE PREFERRED EMBODIMENTS

A. General Construction of the Press Control System

Figure 1A:
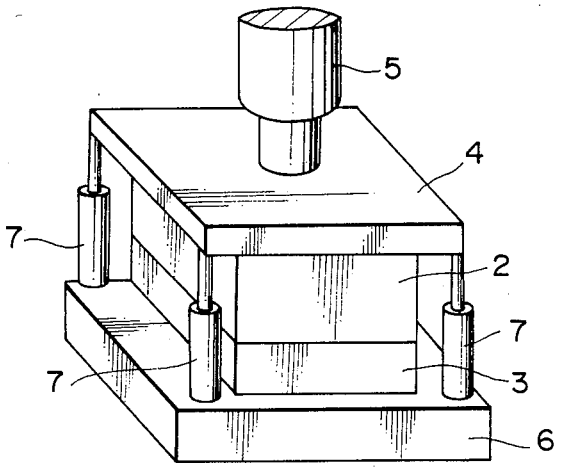
FIG. 1(*a*) is a perspective view of a press to which the present invention is applied.
Figure 1B:
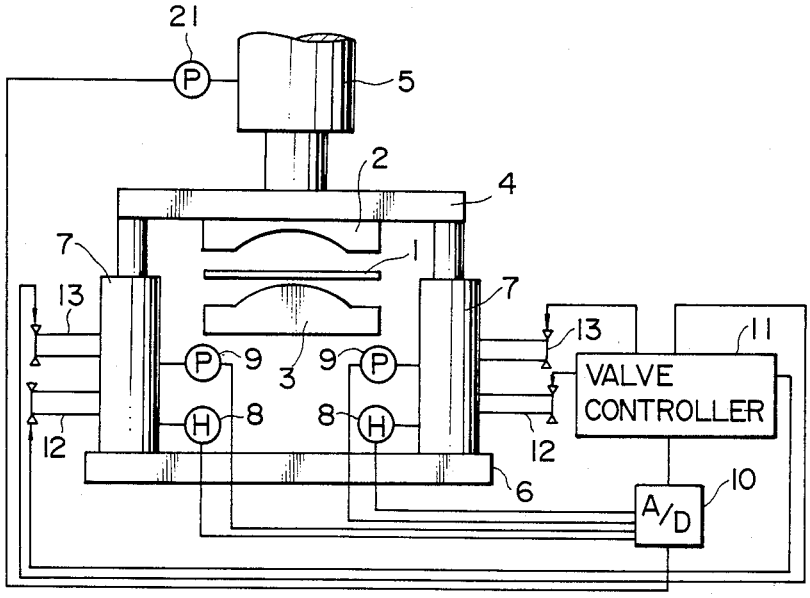

Referring to FIG. 1(*a*), a press comprises a movable die 2, a fixed die 3, a press slide 4 carrying the movable die 2, a pressure cylinder 5 for operating the press slide 4, a bed 6 fixedly mounted with the fixed die 3, and control cylinders 7 fixed at the lower end to the bed 6 and connected to the press slide 4 at the respective upper ends thereof to support the press slide 4 at the four corners thereof.

A pressure detector 21 is associated with the pressure cylinder 5 to detect the operative pressure of the pressure cylinder 5. Each control cylinder 7 is provided with a first control valve 12, such as a quick-response 2-position electromagnetic valve, and a second valve 13, such as an electromagnetic servovalve. The first control valve 12 is capable of operating at a high speed to adjust the height of the control cylinder 7 quickly while the second control valve 13 regulates the operative pressure of the control cylinder 7 gradually. The first control valves 12 and the second control valves 13 are controlled by a valve controller 11.

A position detector 8 and a pressure detector 9 are associated with each control cylinder 7. The position detector 8 detects the height of the control cylinder 7, namely, the height of the related corner of the press slide 4. The pressure detector 9 detects the operative pressure of the control cylinder 7. The height and operative pressure of the control cylinder of the control cylinder 7 vary momentarily as functions of the operative pressure of the pressure cylinder 5 and the reactive force of a workpiece 1.

An AD converter 10 receives the respective analog output position signals of the position detectors 8 representing the respective heights of the control cylinders 7 and the respective analog output pressure signals of the pressure detectors 9 and 21 representing the operative pressures of the control cylinders 7 and the pressure cylinder 5 as input signals, and then gives digital signals respectively corresponding to the input signals to the control unit 11.

The control unit 11 provides signals produced by using the digital input signals given thereto from the AD converter 10 as parameters to control the first control valves 12 and the second control valves 13 according to a control method, which will be described hereinafter. The first control valves 12 are operated at a high operating speed to regulate the respective heights of the control cylinders 7 to maintain the press slide 4 in a level position, while the second control valves 13 regulate the operative pressures of the control cylinders 7 to adjust the respective operative pressure of the control cylinders 7 to target pressures so that a fixed pressure is applied always to the workpiece 1. The foregoing control procedure is repeated until the completion of pressing the workpiece 1.

B. Press Control System In a First Embodiment

B-I Construction and Control Mode

Figure 2:
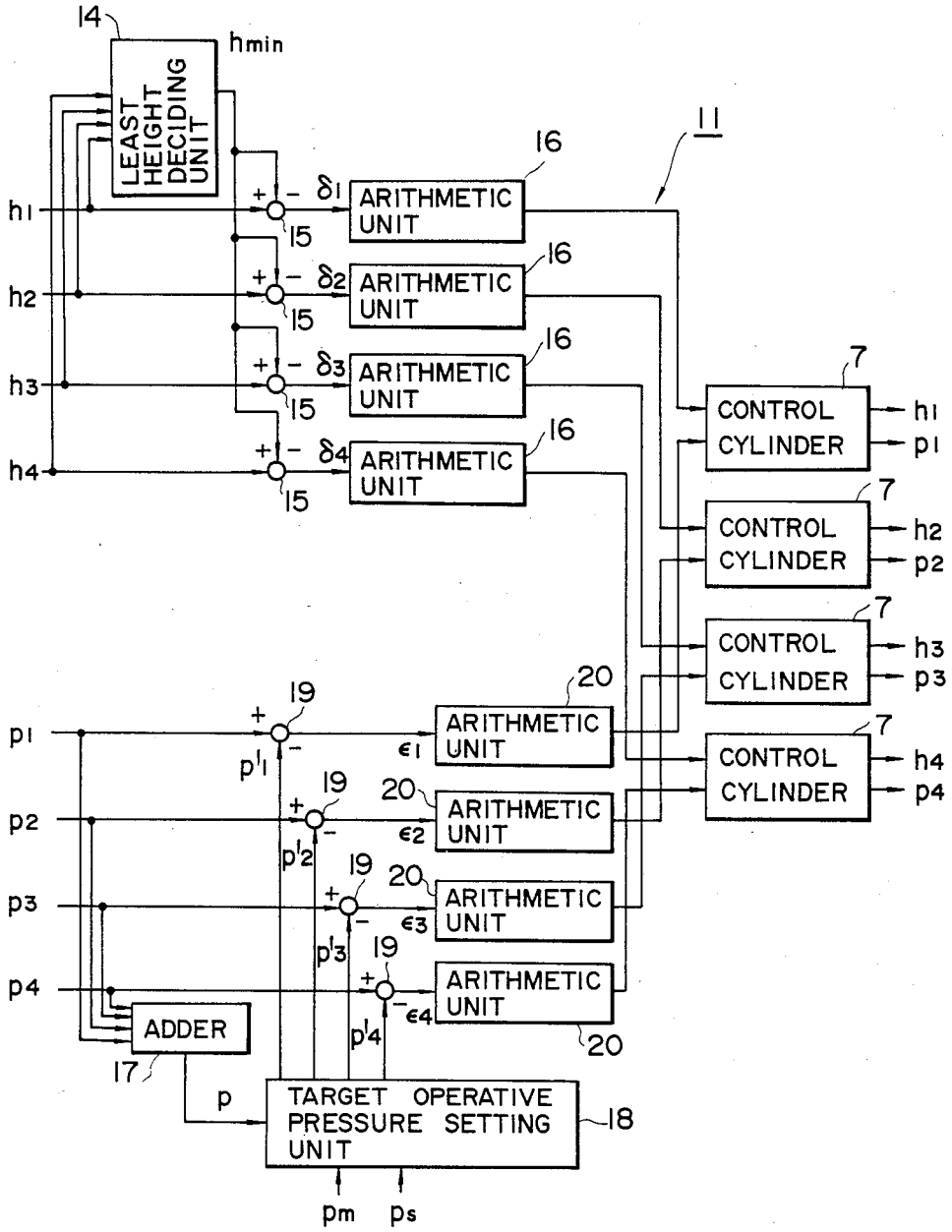
FIG. 2 is a block diagram of the press control system of FIG. 1(*b*)

Referring to FIG. 2 showing the construction of a press control system, in a first embodiment, according to the present invention, $h_1$ to $h_4$ denote the respective heights of the control cylinders 7, respectively, $P_1$ to $P_4$ denote the respective operative pressures of the control cylinders 7, and Pm denotes the operative pressure of the pressure cylinder 5.

The heights $h_1$ to $h_4$ are given to a least height deciding unit 14, and then the least height deciding unit 14 selects the minimum height $h_{min}$ among the heights $h_1$ to $h_4$ The minimum height $h_{min}$ is subtracted from the heights $h_1$ to $h_4$ by subtracters 15 to provide manipulated variables $\delta_1$ to $\delta_4$ respectively for the control cylinders 7. Arithmetic units 16 multiply the manipulated variables $\delta_1$ to $\delta_4$ by a proportional constant $R_l$ to provide control signals for controlling the first control valves 12 so that the respective heights of the control cylinders 7 are brought rapidly into coincidence with each other.

An adder 17 adds the respective detected operative pressures $P_1$ to $P_4$ of the control cylinders 7 to obtain a total pressure P. A target operative pressure setting unit 18 for setting target operative pressures decides target pressures $P_1'$ to $P_4'$ respectively for the control cylinders 7 by using the total pressure P, the operative pressure $P_m$ of the pressure cylinder 5, and a target working pressure $P_s$ to be applied to the workpiece 1 as parameters so that $\Delta P = P - P' = 0$, where $P' = P_m - P_s$. The target working pressure $P_s$ is predetermined taking the quality of the workpiece 1 into consideration. In the simplest case, $P_1'$ to $P_4'$ are equal.

Manipulated variables $\epsilon_1$ to $\epsilon_4$ obtained by calculating the respective differences between $P_1$ to $P_4$ and $P_1'$ to $P_4'$ by subtracters 19 are multiplied by a proportional constant $K_p$ by arithmetic units 20 to obtain control variables. Then, control signals respectively corresponding to the control variables are applied to the second control valves 13 to adjust gradually the operative pressures of the control cylinders 7 to the target operative pressures $P_1'$ to $P_4'$, respectively. Consequently, the working pressure acting on the workpiece is maintained at the target working pressure $P_s$.

Among the foregoing two control operations, priority is given to the height control operation. That is, the height control operation employs the first control valves 12 for quick height adjustment, while the pressure control operation employs the second control valves 13 for gradual pressure adjustment. Accordingly, the height control operation and the pressure control operation will not interfere with each other, so that the control cylinders 7 are controlled through a single control loop.

B-II Modification

Figure 3:
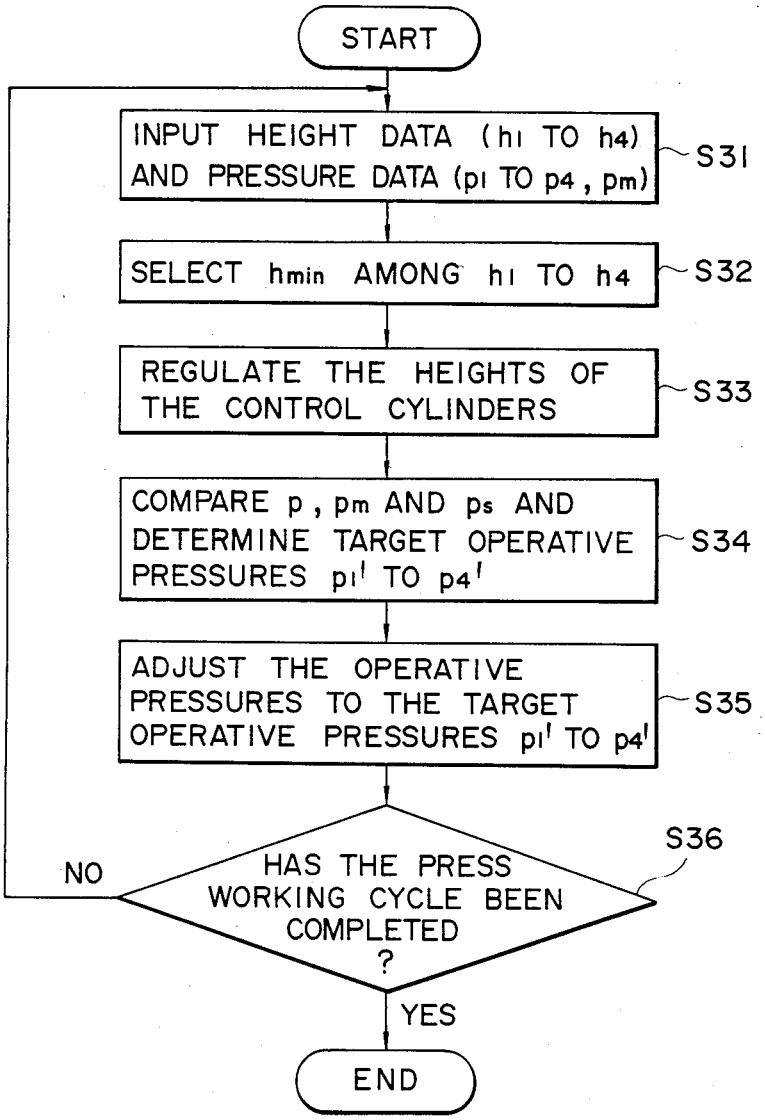
FIG. 3 is a flow chart showing the control routine of a microcomputer employed in the press control system of FIG. 1(*b*)

The foregoing press control system 11 may be embodied in a control system employing a microcomputer. FIG. 3 is a flow chart of a control routine of such a press control system 11 employing a microcomputer.

Referring to FIG. 3, the detectors give signals representing the respective heights $h_1$ to $h_4$ of the control cylinders 7, the respective operative pressures $P_1$ to $P_4$ of the control cylinders 7, and the operative pressure Pm of the pressure cylinder 5 through the AD converter 10 to the microcomputer at step S31.

At step S32, the minimum height $h_{min}$ among the heights $h_1$ to $h_4$ is selected.

At step S33, the minimum height $h_{min}$ is subtracted from the heights $h_1$ to $h_4$ to obtain necessary manipulated variables $\delta_1$ to $\delta_4$ to adjust the respective heights of the control cylinders 7 to the minimum height $h_{min}$, the manipulated variables $\delta_1$ to $\delta_4$ are multiplied by the proportional constant $R_l$ to obtain control variables, and then control signals corresponding to the control variables are given to the first control valves 12 to adjust the respective heights of the control cylinders 7 quickly to the minimum height $h_{min}$.

At step S34, the operative pressures $P_1$ to $P_4$ are added to obtain the total operative pressure P, and then the total operative pressure P, the operative pressure $P_m$ of the pressure cylinder 5 and the predetermined target working pressure $P_s$ to be applied to the workpiece 1 are compared using expressions:

$$P' = P_m - P_s$$

$$\Delta P = P - P'$$

to determine the target operative pressures $P_1'$ to $P_4'$ control cylinders 7 so as to reduce $\Delta P$ to zero.

At step S35, the manipulated variables $\epsilon_1$ to $\epsilon_4$ are obtained by calculating the respective differences between the detected operative pressures $P_1$ to $P_4$ and the target operative pressures $P_1'$ to $P_4'$, the manipulated variables $\epsilon_1$ to $\epsilon_4$ are multiplied by the proportional constant $K_p$ to provide control variables, and then control signals respectively corresponding to the control variables are given to the second control valves 13, respectively, to adjust the operative pressures of the control cylinders gradually to the target operative pressures $P_1'$ to $P_4'$, respectively.

At step S36, a decision is made as to whether or not the press working cycle has been completed and, if not, steps S31 to S35 are repeated to maintain the working pressure acting on the workpiece at the target working pressure $P_s$.

Thus, according to the present invention, the height control operation and the pressure control operation are carried out through a single control loop, whereby the control procedure is simplified and external influence on the control operation is reduced. The employment of the microcomputer enables delicate adjustment of the height and operative pressure of the control cylinders meeting the condition of the workpiece and ambient conditions. Furthermore, since the position of the slide press is regulated directly by regulating the respective heights of the control cylinders instead of regulating the respective ram speeds of the control cylinders, the response of the regulating operation to the variation of the position of the press slide and the accuracy of the regulating operation are improved.

Still further, since any control operation is not applied to the pressure cylinder 5, the application of the press control system to a conventional press of inferior accuracy will improve the accuracy of the press.

C. Press Control System in a Second Embodiment

C-I Construction and Control Mode

A press control system 11, in a second embodiment, according to the present invention, similarly to the press control system 11 in the first embodiment, functions using the respective heights $h_1$ to $h_4$ of the control cylinders 7 detected by the detectors 8, the respective operative pressures $P_1$ to $P_4$ of the control cylinders 7 detected by the detectors 9 and the operative pressure $P_m$ of the pressure cylinder 5 detected by the detector 21.

Figure 4:
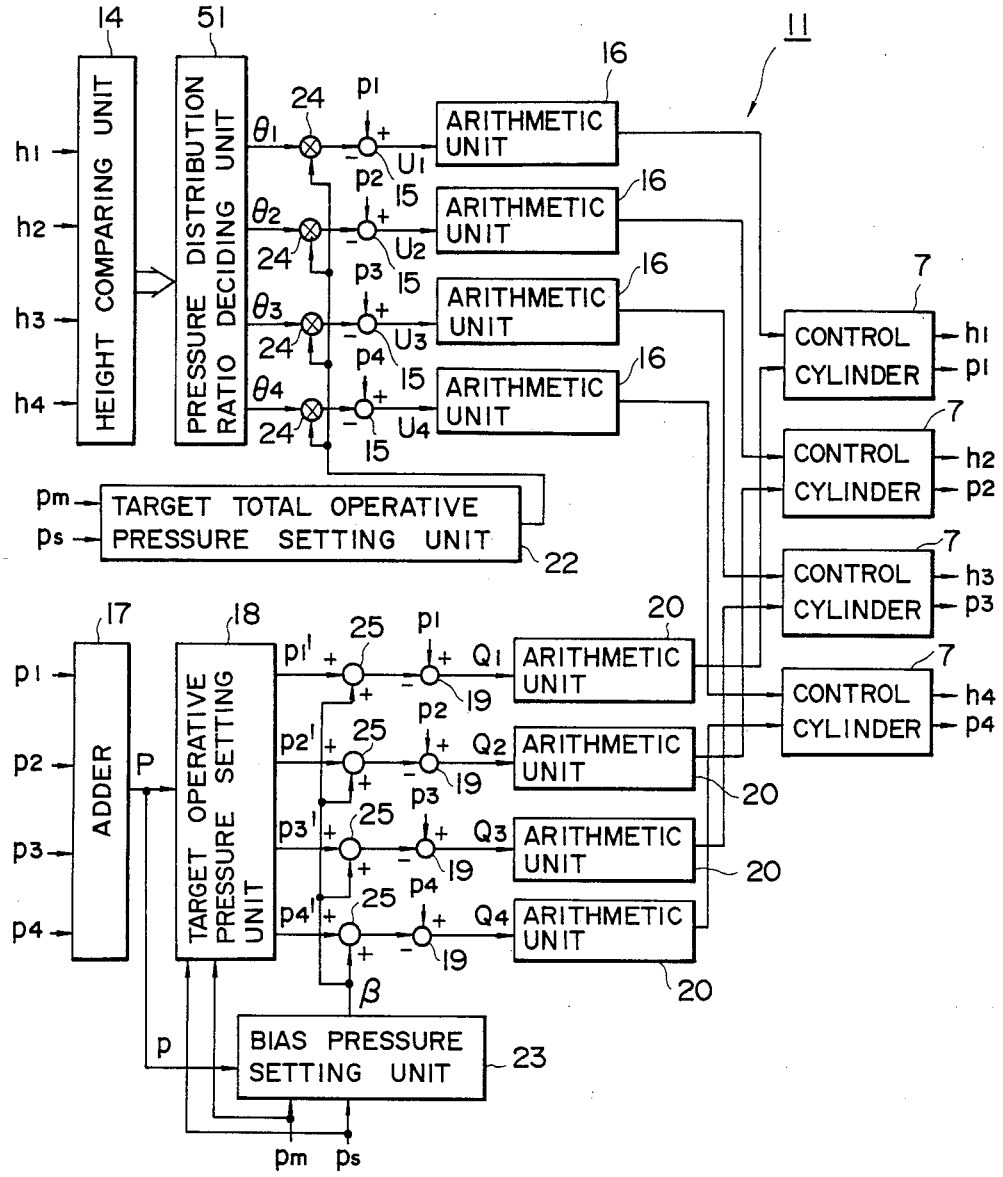
FIG. 4 is a block diagram of a press control system, in a second embodiment, according to the present invention.

Referring to FIG. 4, a height comparing unit 14 rearranges the heights $h_1$ to $h_4$ in order of magnitude. Then, pressure distribution ratios $\theta_1$ to $\theta_4$ respectively for the control cylinders 7 are decided by a pressure distribution ratio deciding unit 51, which will be described hereinafter, on the basis of parameters $l_1$ to $l_4$ respectively representing the detected heights arranged in order of magnitude.

A target total operative pressure setting unit 22 sets a target total operative pressure $P' = P_m - P_s$, where $P_s$ is a target working pressure determined beforehand taking the quality of the workpiece into consideration.

Multipliers 24 multiply the target total operative pressure P' by the pressure distribution ratios $\theta_1$ to $\theta_4$, respectively, and then subtracters 15 calculates the respective differences between the results of the multiplication by the multipliers 24 and $P_1$ to $P_4$ to provide manipulated variables $U_1$ to $U_4$. Then, arithmetic units 16 multiply the manipulated variables $U_1$ to $U_4$ by a proportional constant $R_l$ to provide control variables, and then give control signals corresponding to the control variables to the first control valves 12 to regulate the respective heights of the control cylinders 7 quickly so that the respective heights of the control cylinders become equal.

On the other hand, an adder adds $P_1$ to $P_4$ to obtain the total operative pressure P. Then, a target operative pressure setting unit 18 sets target operative pressures $P_1'$ to $P_4'$, respectively for the control cylinders 7 on the basis of the total operative pressure P, the operative pressure $P_m$ of the pressure cylinder 5 and a target working pressure $P_s$ to be applied to the workpiece 1 so that $\Delta P = P - P' = 0$, where $P' = P_m - P_s$. In a most simple way, the difference $\Delta P$ may be distributed evenly to determine the target operative pressures $P_1'$ to $P_4'$. To obviate the interference of the pressure control operation with the height control operation, the difference $\Delta P$ may be distributed by using the pressure distribution ratios $\theta_1$ to $\theta_4$ decided by the pressure distribution ratio deciding unit 51.

A bias pressure setting unit 23 calculates an actual working pressure $P_r = P_m - P$, and then compares the actual working pressure $P_r$ and the target working pressure $P_s$ to obtain a bias pressure $\beta$ for the fine adjustment of controlled variable. Then, the bias pressure $\beta$ is added to the target operative pressures $P_1'$ to $P_4'$ by adders 25, and then the respective differences between the additions and $P_1$ to $P_4$ are calculated by subtracters 19 to obtain target manipulated variables $Q_1$ to $Q_4$.

Arithmetic units 20 multiply the manipulated variables $Q_1$ to $Q_4$ by a proportional constant $K_p$ to provide control variables and give control signals corresponding to the control variables to the second control valves 13 to adjust the operative pressures of the control cylinders 7 gradually to the target operative pressures $P_1'$ to $P_4'$, respectively. Thus, the working pressure applied to the workpiece is maintained at the target working pressure $P_s$.

Priority is given to the height control operation among those two control operations. The respective heights of the control cylinders are regulated quickly by controlling the first control valves 12, while the respective operative pressures of the same are regulated gradually by controlling the second control valves 13. Accordingly, the height control operation and the operative pressure control operation can be achieved through a single control cylinder control loop without significant interference therebetween.

Furthermore, since the bias pressure $\beta$ is calculated and renewed momentarily, the respective operative pressures of the control cylinders can be accurately adjusted to the target operative pressures $P_1'$ to $P_4'$.

C-II Pressure Distribution Ratio Deciding Procedure

Initial values for the pressure distribution ratios $\theta_1$ to $\theta_4$ are 0.25. Correction parameters $\mu_1$ to $\mu_4$, which will be described hereinafter, are decided from the deviations of the heights $h_1$ to $h_4$ Pressure distribution ratios $\theta_1$ to $\theta_4$ are obtained from expressions:

$$\theta_i=\theta_i+\mu_i \ (i=1, 2, 3, 4) \quad (1)$$

Figure 5:
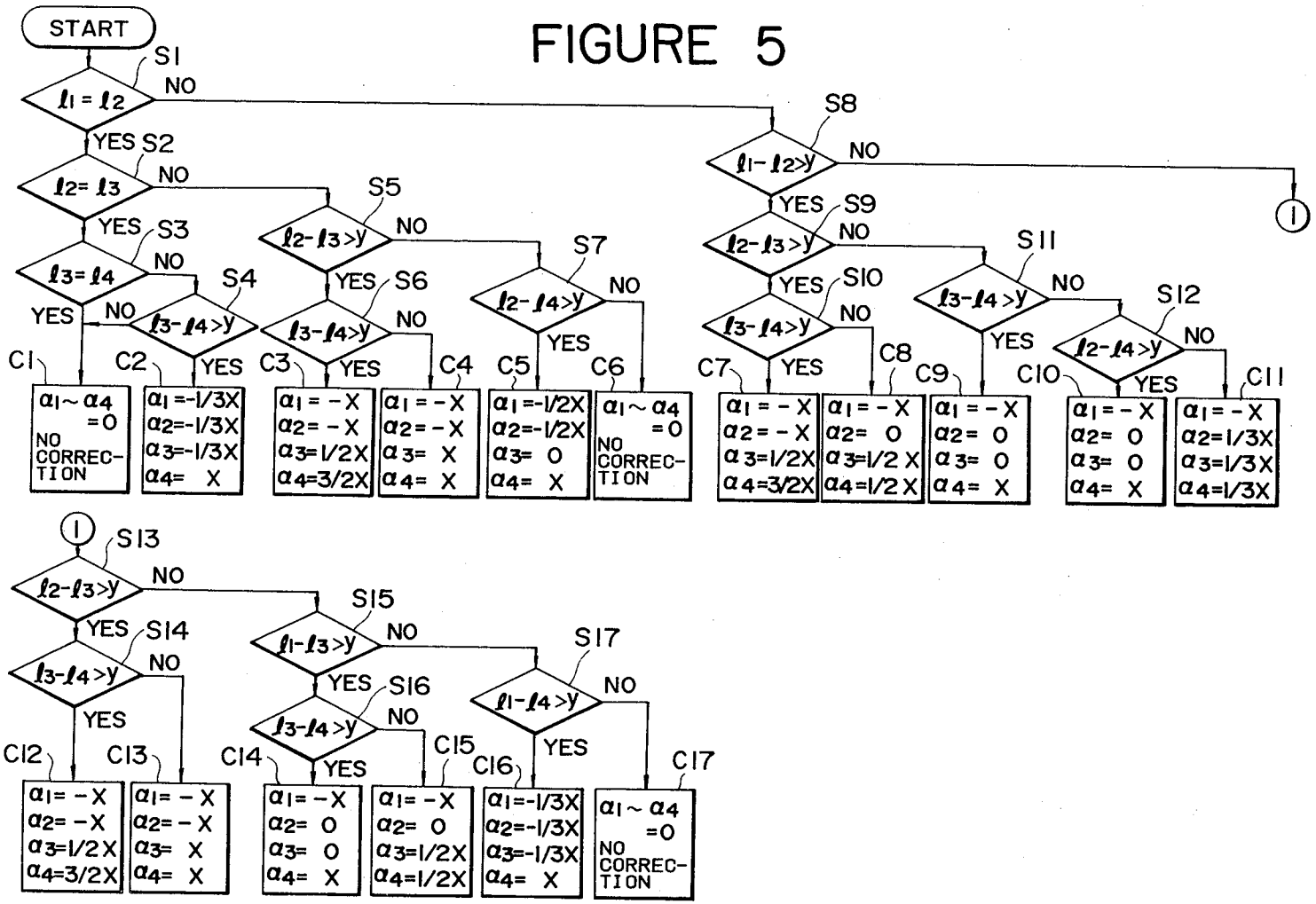
FIG. 5 is a flow chart showing a procedure taken by the pressure distribution ratio deciding unit of the press control system of FIG. 4 to obtain a correction parameter.

In FIG. 5 showing a flow chart of an exemplary routine for determining the correction parameters, the sequence of $l_1$ to $l_4$ is a sequence of the heights $h_1$ to $h_4$ in order of magnitude, x is a predetermined basic height correction, and y is a reference height difference. When the height difference is greater than the reference height difference y, compared heights are considered to be different from each other. As shown in FIG. 5, there are seventeen height regulating modes C1 to C17, which will be described hereinafter with reference to examples.

EXAMPLE 1

$$l_1=l_2>l_3>l_4$$

Decision at step S1 is YES, decision at step S2 is NO, and decision at step S5 is YES (the difference between $l_2$ and $l_3$ is greater than the reference difference y). Consequently, mode C3 is selected. If $h_1$, $h_2$, $h_3$ and $h_4$ correspond to $l_2$, $l_3$, $l_4$ and $l_1$, respectively, $\mu_1=\alpha_2=-x$, $\mu_2=\alpha_3=x/2$, $\mu_3=\alpha_4=3x/2$, and $\mu_4=\alpha_1=-x$. Therefore, pressure distribution ratios are:

$$\theta_1=\theta_1-x$$

$$\theta_2=\theta_2+x/2$$

$$\theta_3=\theta_3+3x/2$$

$$\theta_4=\theta_4-x$$

Thus, smaller pressure distribution ratios are assigned to the control cylinders respectively having relatively large heights ($h_1$ and $h_4$, in this example) and larger pressure distribution ratios are assigned to the control cylinders respectively having relatively small heights ($h_2$ and $h_3$, in this example) for height adjustment.

EXAMPLE 2

$$l_1>l_2\div l_3,\ l_3\div l_4,\ l_2>l_4$$

Decision at step S1 is NO, decision at step S8 is YES, decision ate step S9 is NO ($l_2\div l_3$ and hence the difference between them is smaller than y), decision at step S11 is NO ($l_3\div l_4$), and decision at step S12 is YES (the difference between $l_2$ and $l_4$ is significant, namely, the difference between them is greater than y). Consequently, this example falls in height regulating mode C10. The rest of the procedure is the same as that for the Example 1.

Thus, the correction parameters $\mu_1$ to $\mu_4$ are decided depending on the differences between the heights $l_1$ to $l_4$.

C-III Bias Pressure Setting Procedure

C-III-1 Importance of Bias Pressure for Press Working

The range of the target working pressure $P_s$ is as wide as 10 to 1500 tw/m$^2$. It is known empirically that addition of an appropriate bias pressure according to the target working pressure $P_s$ to a manipulated variable for the servocontrol of the working pressure improves the accuracy of the servocontrol. However, in some cases, the working pressure cannot be controlled at an expected accuracy due to the variation of the ambient conditions, such as the temperature of the hydraulic fluid and the ambient temperature, even when an appropriate bias pressure is determined prior to starting press working. Accordingly, the bias pressure $\beta$ needs to be reset during the press working.

C-III-2 Bias Pressure Setting Procedure

When a measured working pressure Pr is smaller than the target working pressure $P_s$ ($P_r<P_s$), the initially set bias pressure $\beta$ is considered to be excessively large, and then a correction $\gamma$ ($\gamma>0$) is subtracted from the initially set bias pressure $\beta$ ($\beta=\beta-\gamma$) to set a new bias pressure.

When $P_r>P_s$, the initially set bias pressure is considered to be excessively small and the correction $\gamma$ is added to the initially set bias pressure $\beta$ ($\beta=\beta+\gamma$).

When $P_r=P_s$, the initially set bias pressure $\beta$ is maintained.

C-III-3 Effect of Bias Pressure Setting

It was proved from practical press working that resetting the bias pressure $\beta$ from time to time during the press working on the basis of the results of comparison of the measured working pressure $P_r$ and the target working pressure $P_s$ enables the accurate control of the working pressure with an error within 5.5% regardless of the conditions f the press working.

C-IV Application of Microcomputer

Figure 6:
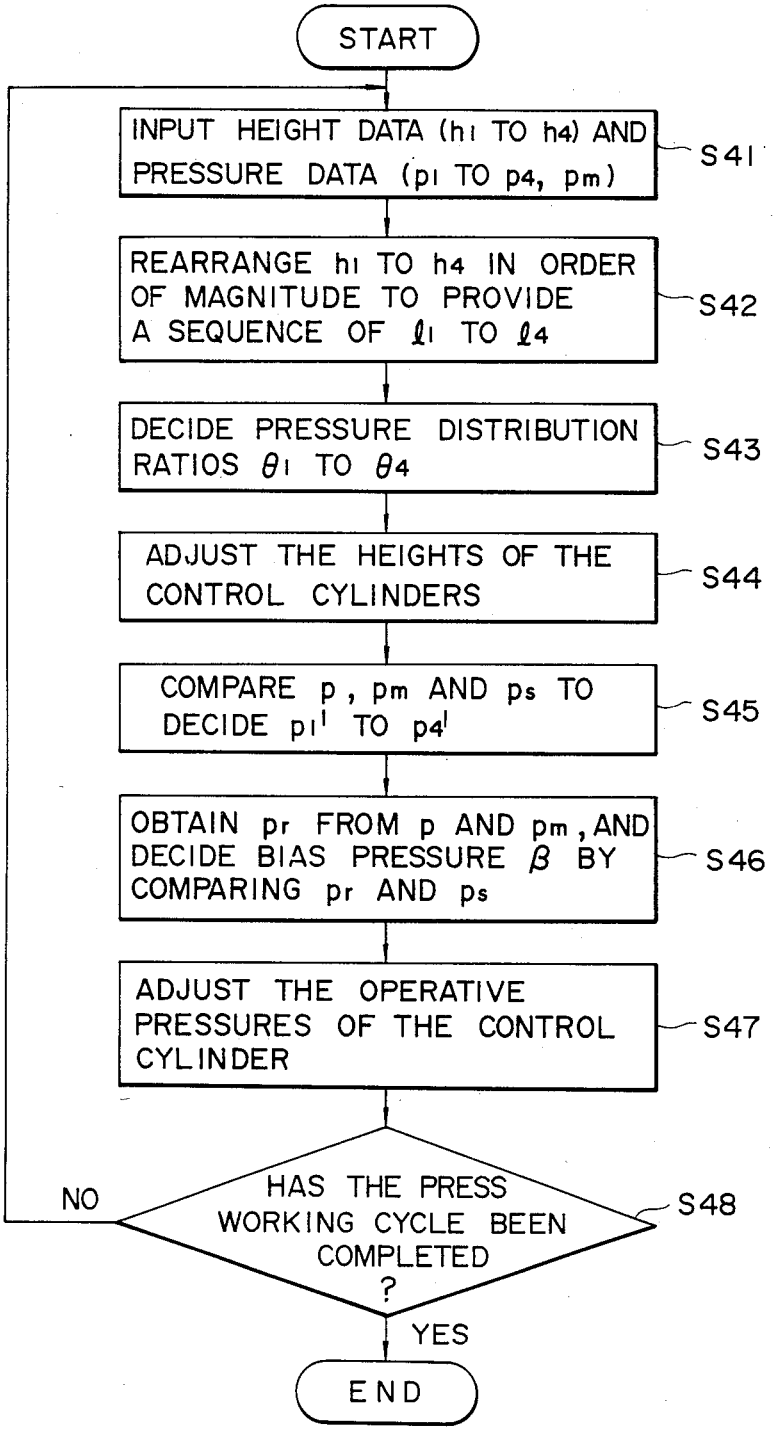
FIG. 6 is a flow chart showing the control routine of a microcomputer employed in the press control system of FIG. 4.

The functions of the press control system 11, in the second embodiment, can be implemented by a microcomputer. FIG. 6 shows a control routine to be executed by the press control system 11 employing a microcomputer.

At step S41, the detectors give the respective heights $h_1$ to $h_4$ and the respective operative pressures $P_1$ to $P_4$ of the control cylinders and the operative pressure $P_m$ of the pressure cylinder through the AD converter 10 to the microcomputer.

At step S42, the heights $h_1$ to $h_4$ are compared and are arranged in a sequence of $l_1$ to $l_4$ in order of magnitude. Then, at step S43, pressure distribution ratios $\theta_1$ to $\theta_4$ respectively for the control cylinders 7 are decided on the basis of $l_1$ to $l_4$ by the pressure distribution ratio deciding procedure described in C-II. Then, at step S44, the target total operative pressure $P'=P_m-P_s$ to be applied to the workpiece 1 is calculated, and the target total operative pressure P' is multiplied by the pressure distribution ratios $\theta_1$ to $\theta_4$, then the respective differences of the results of multiplication and the operative pressures $P_1$ to $P_4$ are calculated to provide the manipulated variables $\delta_1$ to $\delta_4$, then the manipulated variables are multiplied by the proportional constant $R_l$ to obtain control variables, and then control signals corresponding to the control variables are applied to the first control valves 12 to make the respective heights of the control cylinders 7 equal.

At step S45, the operative pressures $P_1$ to $P_4$ are added to obtain the total operative pressure P and the target operative pressures $P_1'$ to $P_4'$ for the control cylinders 7 are set so that $\Delta P=P-P'$, where P is the addition of the operative pressures $P_1$ to $P_4$, $P'=P_m-P_s$.

At step S46, $P_r$(measured working pressure)$=P_m-P$ is calculated, and then the bias pressure $\beta$ is provided on the basis of comparison of the measured working pressure $P_r$ and the target working pressure $P_s$ through the bias pressure deciding procedure described in C-III. Then, at step S47, the bias pressure $\beta$ is added to the target operative pressures $P_1'$ to $P_4'$, then target manipulated pressures $Q_1$ to $Q_4$, namely, the respective differences between the operative pressures $P_1$ to $P_4$ and the target operative pressures $P_1'$ to $P_4'$, is calculated, then the target manipulated variables $Q_1$ to $Q_4$ are multiplied by the proportional constant $K_p$ to obtain control variables, and then control signals corresponding to the control variables are applied to the second control valves 13 to adjust the respective operative pressures gradually to the target operative pressures $P_1'$ to $P_4'$. At step S48, a decision is made as to whether or not the press working cycle has been completed. Steps S41 to S47 is repeated until the press working cycle is completed to maintain the press slide 4 in a level position and to maintain the actual working pressure working on the workpiece at the target working pressure $P_s$.

Thus, the execution of the height control operation and the pressure control operation through a single control loop simplifies the control procedure and reduces external influence on the control operation. Furthermore, the employment of the microcomputer enables delicate control of the press working operation according to the ambient conditions and the state of the workpiece. Still further, the direct control of the respective heights of the control cylinders instead of the conventional indirect control of the respective heights of the control cylinders through the control of the ram speed of the control cylinders improves the response characteristics and accuracy of the press control system.

Still further, since any control operation is not applied to the pressure cylinder 5, the application of the press control system to a conventional press of inferior accuracy will improve the accuracy of the press.

Furthermore, since the second embodiment uses the pressure distribution ratios and the bias pressure as data for the control operation, the accuracy of the height and pressure control operation of the second embodiment is higher than that of the first embodiment as described in paragraph B.

D. Press Control System in a Third Embodiment

Even if the press control system is capable of only the height control operation as described with reference to the second embodiment in paragraph C, substantial press work control effect is expected. The third embodiment is adapted only for the height control operation.

Figure 7:
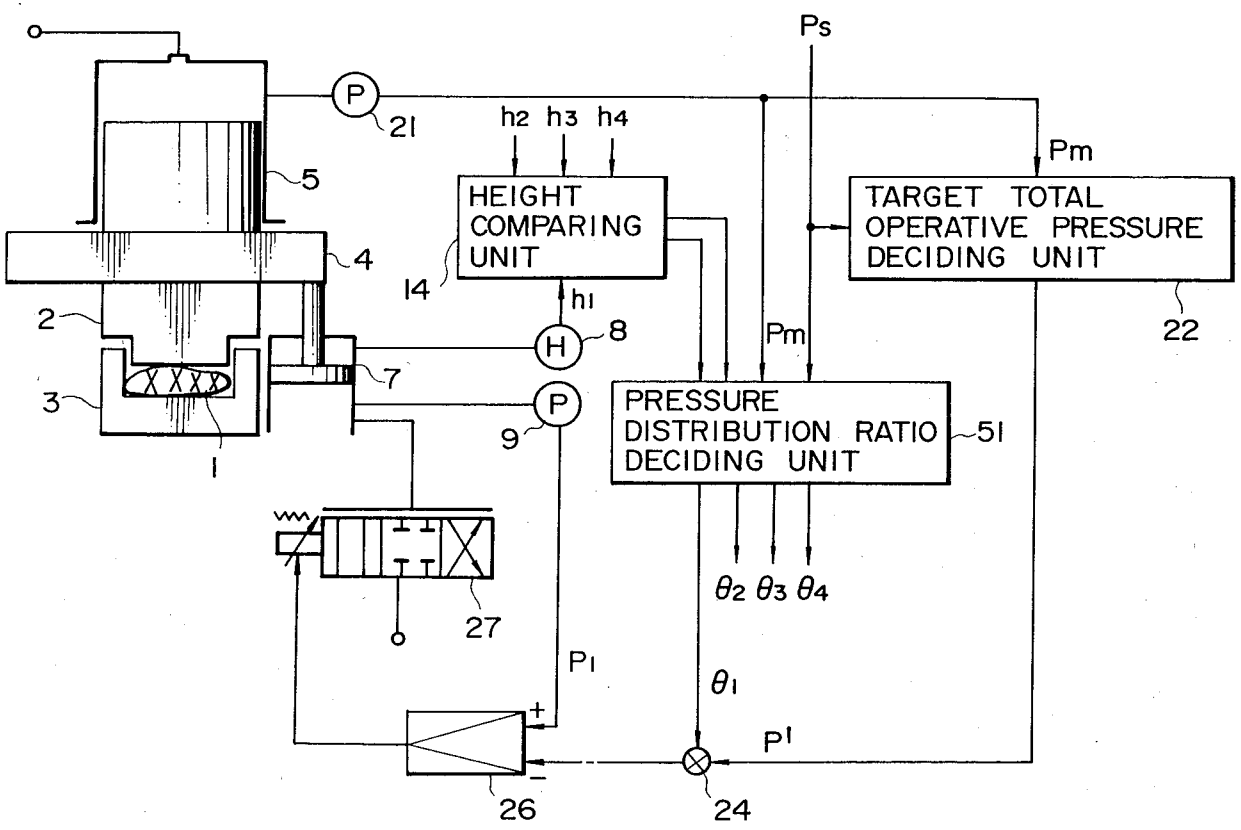
FIG. 7 is a diagrammatic illustration of a press control system, in a third embodiment, according to the present invention only for height control.

Referring to FIG. 7, in which only one of the control cylinders and the associated components are shown, a servoamplifier 26 corresponds to the subtracter 15 and the arithmetic unit 16 of FIG. 4, while a servovalve 27 corresponds to the first control valve 12. The rest of the constitution of the third embodiment is the same as those described in paragraphs A and C, and hence the description thereof will be omitted.

The third embodiment executes only the height control operation. Therefore, a digital control mode for the on-off control of the first control valves 12 to avoid interference between the height control operation and the pressure control operation is unnecessary. Accordingly, accurate height control operation can be achieved through the continuous analog control of the servovalve 27. The third embodiment provides an additional pressure control effect on the working pressure through the change of the pressure distribution ratios $\theta_1$ to $\theta_4$.

Furthermore, since only height is the objective controlled variable of the third embodiment, the height control operation is never interfered with by the pressure control operation, and hence the constitution thereof and that of the associated equipments are simplified.

E. Press Control System in a Fourth Embodiment

Figure 8:
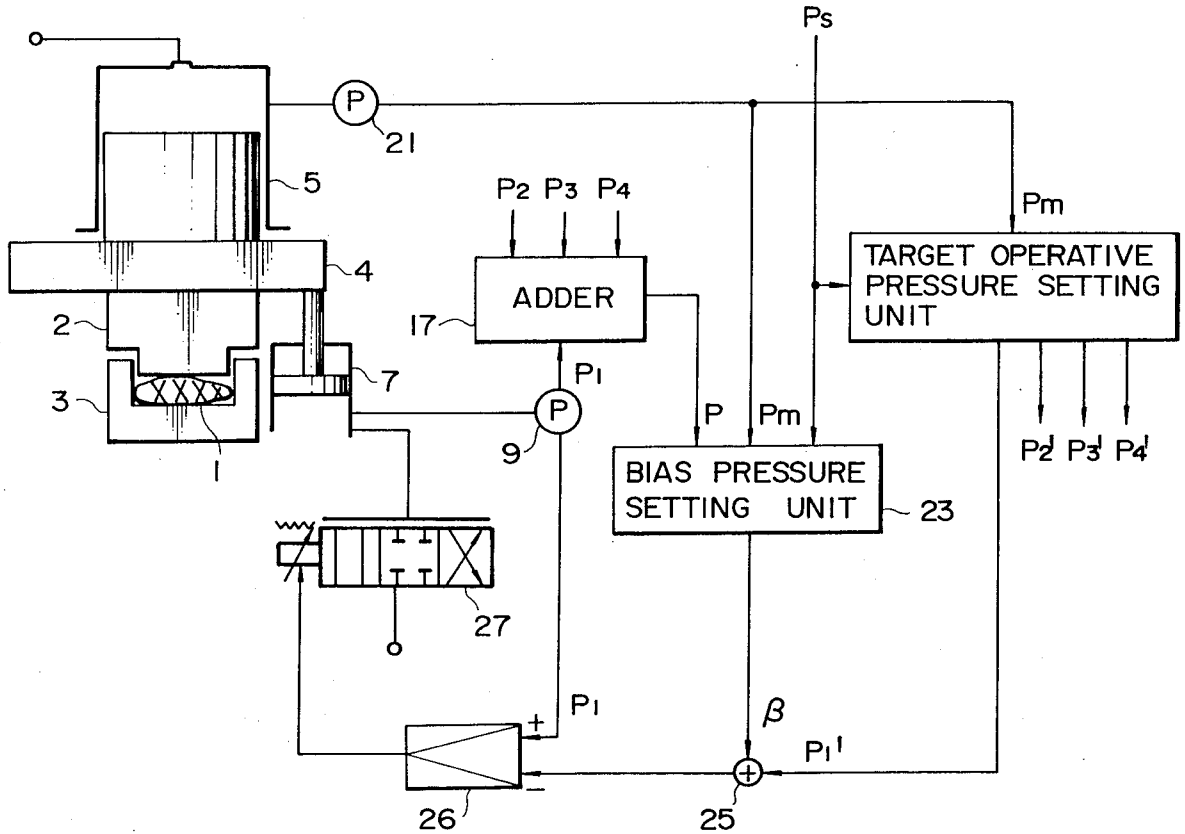
FIG. 8 is a diagrammatic illustration of a press control system, in a fourth embodiment, according to the present invention only for pressure control.

Even if the press control system is capable of only the pressure control operation as described with reference to the second embodiment in paragraph C, substantial press working control effect is expected. FIG. 8 illustrates the constitution of the fourth embodiment. Since the constitution and functions of the fourth embodiment are included in the description provided in paragraphs A, C and D, the description thereof will be omitted.

Similarly to the third embodiment, since pressure is only the objective controlled variable of the fourth embodiment, the fourth embodiment is never bothered by interference between the pressure control operation and height control operation, whereby the constitution is simplified (elimination of the position detectors).

Although the arithmetic units employed in the first to fourth embodiments are of a proportional type, the arithmetic units may be of a derivative type, an integrating type or a feed-forward type depending on the characteristics of the workpiece or the characteristics of the hydraulic system. Furthermore, the first control valve 12 for height control and the second control valve 13 for pressure control employed in the first and second embodiment may be substituted by a single equivalent valve to simplify the construction of the press. Still further, the second control valves of the third and fourth embodiments can be quick-response control valves for further rapid control.

F. Press Control System in a Fifth Embodiment

Figure 10:
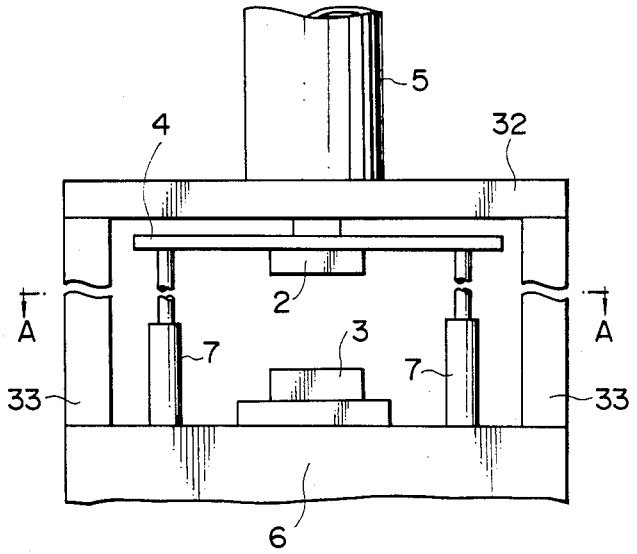
FIG. 10 is a schematic illustration of a press to which the press control system of FIG. 9 is applied.
Figures 11A, 11B:
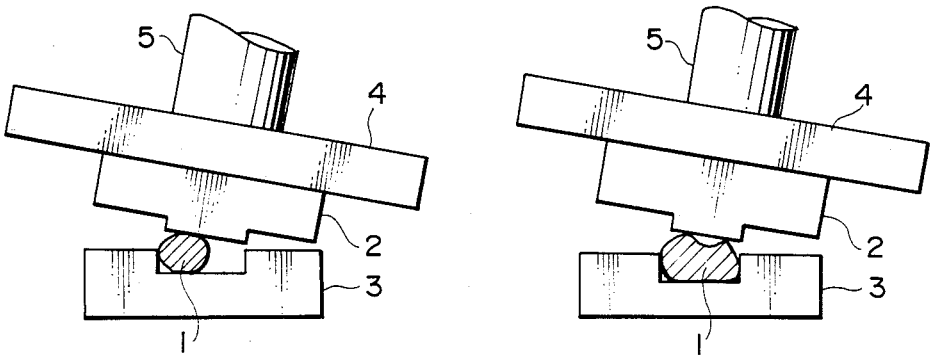
FIGS. 11(*a*) and 11(*b*) are schematic fragmentary views of assistance in explaining the adverse influence of workpieces on the position of a press slide carrying a movable die.

Referring to FIG. 10 showing a hydraulic press for die-forming a resin workpiece such as a SMC resin workpiece, to which a press control system, in a fifth embodiment, according to the present invention is applied, there are shown a movable die 2, a fixed die 3, a press slide 4 carrying the movable die 2, a double-acting pressure cylinder 5 for vertically moving the press slide 4, a bed 6 fixedly mounted with the fixed die 3, and control cylinders 7 provided on the bed 6 at the four corners of the same to support the press slide 4 in a level position during press working.

Figure 9:
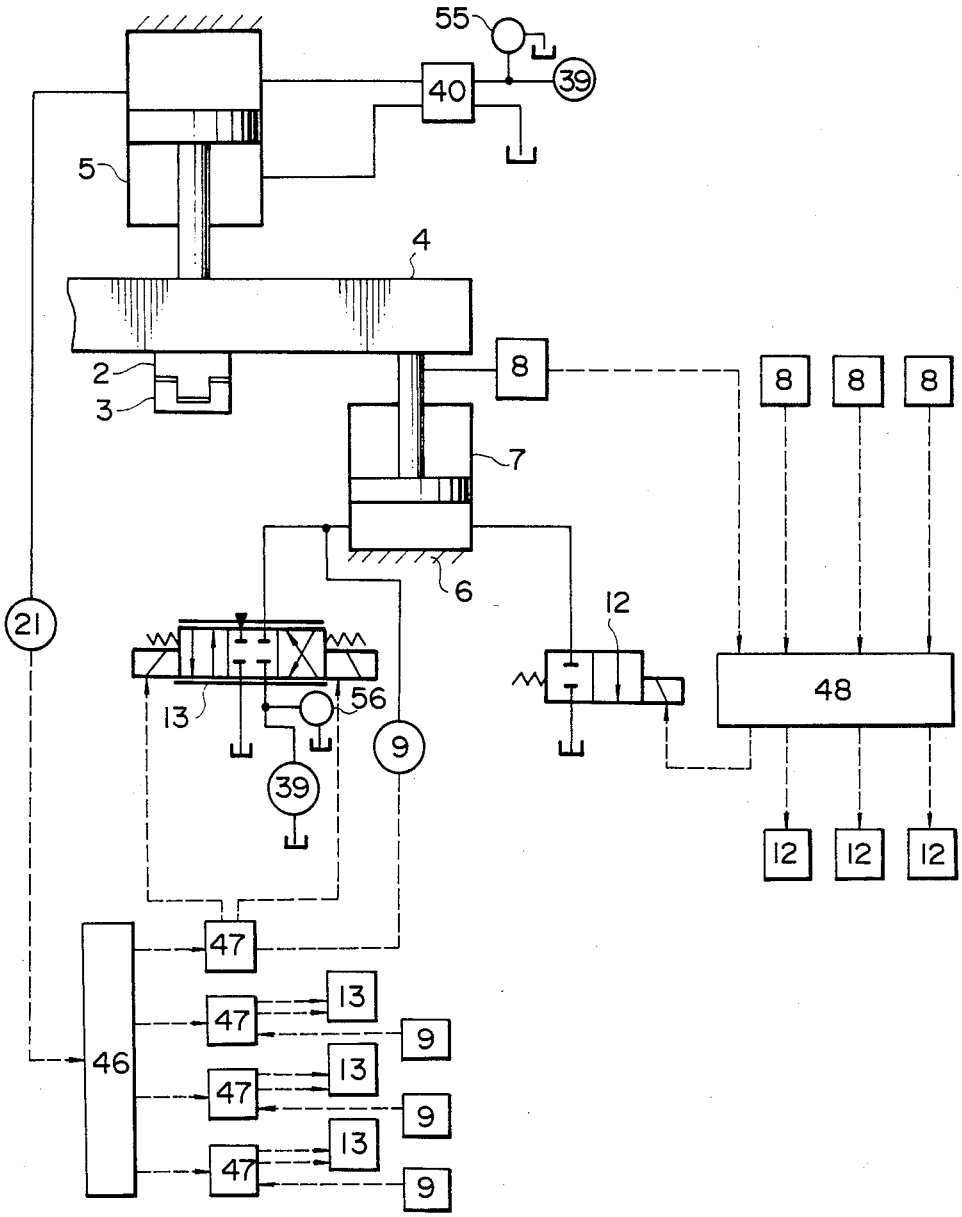
FIG. 9 is a block diagram of a press control system, in a fifth embodiment, according to the present invention.

Referring to FIG. 9 showing the press control system in the fifth embodiment, there are shown a control valve 40 for controlling the operation of the pressure cylinder 5, a pressure detector 21 for detecting the operative pressure of the main cylinder 5, four second control valves 13, such as 4-port 3-position electromagnetic servovalves, for controlling the respective operative pressures of the control cylinders 7, four first control valves 12, such as quick-response 2-position electromagnetic valves, for regulating the respective heights of the control cylinders 7 by opening or shutting lines respectively connecting the respective lower pressure chambers of the control cylinders 7 to a sump to drain a small amount of hydraulic fluid from the respective lower pressure chambers of the control cylinders 7 when necessary, pressure detectors 9 for detecting the respective operative pressures , namely, the supporting forces, of the control cylinders 7, position detectors 8 for detecting the respective heights of the control cylinders 7, namely, the respective vertical positions of the upper ends of the respective rams of the control cylinders 7 representing the respective vertical positions of the four corners of the press slide 4, a working pressure setting unit 46 for setting a working pressure to be applied to the workpiece, servoamplifiers 47 respectively for controlling the second control valves 13 to adjust the actual working pressure acting on the workpiece to a set working pressure, a level comparing unit 48 for controlling the first control valves 12 to maintain the press slide 4 in a level position, and relief valves 55 and 56.

Each first control valve 12 is controlled so as to drain a very small amount of hydraulic fluid from the lower pressure chamber of the associated control cylinder 7 so that pressure variation in the lower pressure chamber due to draining hydraulic fluid therefrom will not affect the control operation of the second control valve 13.

Prior to starting press working, the working pressure setting unit 46 sets a working pressure to be applied to the workpiece.

During press working operation, the operative pressure of each control cylinder 7 is calculated on the basis of data to be taken into consideration, such as the operative pressure of the pressure cylinder 5 detected by the pressure detector 21, the respective operative pressures of the control cylinders 7 detected by the pressure detectors 9, the set working pressure set by the working pressure setting unit 46 and the respective weights of the movable die 2 and the press slide 4, and the results of calculation are applied to the servoamplifiers 47 to control the second control valves 13. At the same time, the operative pressure of each control cylinder 7 detected by the pressure detector 9 is fed to the associated servoamplifier 47 for feedback control of the operative pressure of the control cylinder 7. During the feedback control of the operative pressures of the control cylinders 7, the actual operative pressure of the pressure cylinder 5 is compared continuously with the set operative pressure so that the actual working pressure acting on the workpiece is maintained at the set working pressure.

During the press working operation, the respective heights of the control cylinders 7 affecting the position of the press slide 4, more specifically, the dynamic parallel accuracy of the movable die 2, hence, of the press slide 4, are detected continuously. When the difference between the height of any one of the control cylinders 7 and the minimum height among the detected heights of the control cylinders 7 exceeds a predetermined value, for example, 0.01 mm, the relevant first control valve 12 is controlled so as to drain a very small amount of hydraulic fluid from the lower pressure chamber of the control cylinder 7 to reduce the height of the same so that the press slide 4 is maintained at a parallel accuracy in a predetermined range of parallel accuracy. Since only a very small amount of hydraulic fluid is drained at a time for the height control of the control cylinder 7, the height control operation does not affect the control operation of the second control valves 13.

The first control valves can be control valves other than quick-response 2-position electromagnetic valves, such as electromagnetic servovalves.

As apparent from the foregoing description of the invention, according to the present invention, both the heights and operative pressures of the control cylinders are controlled through a single control loop without entailing interference between the height control operation and the operative pressure control operation, so that the press slide, hence, the movable die, is maintained always at a high dynamic parallel accuracy and the working pressure acting on the workpiece is maintained at a fixed level regardless of the press working conditions.

Furthermore, although the present invention has been described as applied to the press working of a resin workpiece, the present invention is applicable also to press working other materials.

Although the invention has been described in its preferred forms with a certain degree of particularity, as many apparently widely different embodiments thereof may be made without departing from the spirit and scope thereof, it is to be understood that the invention is not limited to the specific embodiments thereof except as defined in the appended claims.

What is claimed is:

1. A press working control method for controlling the press working operation of a press having a pressure cylinder for applying a working pressure to a workpiece, a press slide operatively connected to the pressure cylinder and carrying a movable die, a bed fixedly mounted with a fixed die, and a plurality of control cylinders supporting the press slide and each having one end fixed to the bed and the other end connected to the press slide, to control the dynamic parallel accuracy of the press slide and to control the working pressure acting on the workpiece being pressed on the press, which comprises:

detecting the operative pressures of the pressure cylinder by a first pressure detector;

detecting the respective positions of the control cylinders by position detectors;

detecting the respective operative pressures of the control cylinders by second pressure detectors;

comparing the respective heights of the control cylinders detected by the position detectors by first comparing means;

deciding manipulated variables respectively for the control cylinders by first manipulated variable deciding means on the basis of a result of a comparing operation of the first comparing means, controlling the pressure in the control cylinders by first control means according to the manipulated variables decided by the first manipulated variable deciding means;

determining the working pressure acting on the workpiece by working pressure determining means from the difference between the operative pressure of the pressure cylinder detected by the first pressure detector and a total operative pressure obtained by adding the respective operative pressures of the control cylinders detected by the second pressure detectors;

comparing the working pressure determined by the working pressure determining means and a predetermined target working pressure by second comparing means;

deciding manipulated variables respectively for controlling the control cylinders by second manipulated variable deciding means on the basis of the result of the comparing operation of the second comparing means; and controlling the pressure in the control cylinders by second control means according to the manipulated variables decided by the second manipulated variable deciding means.

2. A press working control method as recited in claim I, wherein the manipulated variables respectively for controlling the control cylinders are determined by obtaining a target total operative pressure for the control cylinders from the difference between the operative pressure of the pressure cylinder detected by the first pressure detector and the target working pressure, and multiplying the target total operative pressure by respective pressure distribution ratios for the pressure in the control cylinders determined by using a pressure distribution ratio deciding unit, by the comparing operation of the first comparing means.

3. A press working control method as recited in claim 1 or 2, wherein the manipulated variables respectively for the control cylinders are decided by the second manipulated variable deciding means by obtaining a target total operative pressure for the control cylinders from a first difference between the operative pressure of the pressure cylinder detected by the first pressure detector and the target working pressure, obtaining a second difference between the target total operative pressure and the total operative pressure of the control cylinders, and adding a bias value, determined variable according to results of the comparing operation of the second comparing means, to values determined on the basis of the second difference and the respective operative pressures of the control cylinders, respectively.

4. A press working control method for controlling the press working operation of a press having a pressure cylinder for applying a working pressure to a workpiece, a press slide operatively connected to the pressure cylinder and carrying a movable die, a bed fixedly mounted with a fixed die, and a plurality of control cylinders supporting the press slide and each having one end fixed to the bed and the other end connected to the slide, to control the dynamic parallel accuracy of the press slide, which comprises:

detecting the operative pressure of the pressure cylinder by a first pressure detector;

detecting the respective heights of the control cylinders by position detectors;

comparing the respective heights of the control cylinders detected by the position detectors, respectively, by comparing means;

deciding a target total operative pressure for the control cylinders by target total operative pressure deciding means from the difference between the operative pressure of the pressure cylinder detected by the pressure detector and a predetermined target working pressure to be applied to a workpiece;

deciding manipulated variables respectively for the control cylinders by manipulated variable deciding means by using a pressure distribution ratio deciding unit for obtaining pressure distribution ratios respectively for the control cylinders on the basis of a result of the comparing operation of the comparing means, and multiplying the target total operative pressure for the control cylinders decided by the target total operative pressure deciding means by the pressure distribution ratios; and controlling the pressure in the control cylinders by control means according to the manipulated variables decided by the manipulated variable deciding means.

5. A press working control method for controlling the press working operation of a press having a pressure cylinder for applying a working pressure to a workpiece, a press slide operatively connected to the pressure cylinder and carrying a movable die, a bed fixedly mounted with a fixed die, and a plurality of control cylinders supporting the press slide and each having one end fixed to the bed and the other end connected to the press slide, to control the working pressure to be applied to the workpiece by the pressure cylinder of the press, which comprises:

detecting the operative pressure of the pressure cylinder by a first pressure detector;

detecting the respective operative pressures of the control cylinders by second pressure detectors;

deciding a target total operative pressure for the control cylinders by target total operative pressure deciding means from the difference between the operative pressure of the pressure cylinder detected by the first pressure detector and a predetermined target working pressure to be applied to the workpiece;

determining the working pressure acting on the workpiece by working pressure determining means from the difference between the operative pressure of the pressure cylinder detected by the first pressure detector and a total operative pressure obtained by adding the respective operative pressures of the control cylinders detected by the second pressure detectors, respectively;

comparing the working pressure determined by the working pressure measuring means and the predetermined target working pressure by comparing means;

deciding manipulated variables respectively for the control cylinders by manipulated variable deciding means by obtaining the difference between the target total operative pressure decided by the target total operative pressure deciding means and the total operative pressure of the control cylinders, and adding a bias value variable, determined according to a result of a comparing operation of the comparing means, to values obtained on the basis of the difference between the target total operative pressure and the total operative pressure of the control cylinders and the respective operative pressures of the control cylinders; and controlling the pressure in the control cylinders by control means according to the manipulated variables decided by the manipulated variable deciding means.

6. A press control system for controlling the press working operation of a press having a pressure cylinder for applying a working pressure to a workpiece, and a press slide operatively connected to the pressure cylinder, the press control system having means to control the dynamic parallel accuracy of the press slide and to control the working pressure acting on the workpiece being pressed on the press, which comprises:

a plurality of control cylinders supporting the press slide and each having one end fixed to a bed of the press and the other end connected to the press slide;

a first pressure detector for detecting the operative pressure of the pressure cylinder;

position detectors respectively for detecting the respective heights of the control cylinders;

second pressure detectors respectively for detecting the respective operative pressures of the control cylinders;

first comparing means for comparing the respective heights of the control cylinders detected by the position detectors;

first manipulated variable deciding means for deciding manipulated variables respectively for the control cylinders on the basis of a result of a comparing operation of the first comparing means;

first control means for controlling the pressure in the control cylinders according to the manipulated variables decided by the first manipulated variable deciding means;

working pressure determining means which determines the working pressure acting on the workpiece from the difference between the operative pressure of the pressure cylinder detected by the first pressure detector and a total operative pressure obtained by adding the respective operative pressures of the control cylinders detected by the second pressure detectors;

second comparing means for comparing the working pressure determined by the working pressure determining means and a predetermined target working pressure;

second manipulated variable deciding means for deciding manipulated variables respectively for controlling the control cylinders on the basis of the result of the comparing operation of the second comparing means; and second control means for controlling the pressure in the control cylinders according to the manipulated variables decided by the second manipulated variable deciding means.

7. A press control system as recited in claim 6, including means such that the manipulated variables respectively for controlling the control cylinders are determined by obtaining a target total operative pressure for the control cylinders from the difference between the operative pressure of the pressure cylinder detected by the first pressure detector and the target working pressure, and multiplying the target total operative pressure by respective pressure distribution ratios for the control cylinders determined from a pressure distribution ratio deciding unit, by the comparing operation of the first comparing means.

8. A press control system as recited in claim 6 or 7, including means such that the manipulated variables respectively for the control cylinders are decided by the second manipulated variable deciding means by obtaining a target total operative pressure for the control cylinders from a first difference between the operative pressure of the pressure cylinder detected by the first pressure detector and the target working pressure, obtaining a second difference between the target total operative pressure and the total operative pressure of the control cylinders, and adding a bias value variable, determined according to results of the comparing operation of the second comparing means, to values determined on the basis of the second difference and the respective operative pressures of the control cylinders, respectively.

9. A press control system for controlling the press working operation of a press having a pressure cylinder for applying a working pressure to a workpiece, and a press slide operatively connected to the pressure cylinder, the press control system having means to control the dynamic parallel accuracy of the press slide, which comprises:

a plurality of control cylinders supporting the press slide and each having one end fixed to the bed of the press and the other end connected to the press slide;

a pressure detector for detecting the operative pressure of the pressure cylinder;

position detectors respectively for detecting the respective heights of the control cylinders;

comparing means for comparing the respective heights of the control cylinders detected by the position detectors, respectively;

target total operative pressure deciding means for deciding a target total operative pressure for the control cylinders from the difference between the operative pressure of the pressure cylinder detected by the pressure detector and a predetermined target working pressure to be applied to a workpiece;

manipulated variable deciding means for deciding manipulated variables respectively for the control cylinders by obtaining respective pressure distribution ratios from a pressure distribution ratio deciding unit for the control cylinders on the basis of a result of the comparing operation of the comparing means, and multiplying the target total operative pressure for the control cylinders decided by the target total operative pressure deciding means by the pressure distribution ratios; and control means for controlling the pressure in the control cylinders according to the manipulated variables decided by the manipulated variable deciding means.

10. A press control system for controlling the press working operation of a press having a pressure cylinder for applying a working pressure to a workpiece, and a press slide operatively connected to the pressure cylinder, the press control system having means to control the working pressure to be applied to the workpiece by the pressure cylinder of the press, which comprises:

a plurality of control cylinders supporting the press slide and each having one end fixed to a bed of the press and the other end connected to the press slide;

a first pressure detector for detecting the operative pressure of the pressure cylinder;

second pressure detectors respectively for detecting the respective operative pressures of the control cylinders;

target total operative pressure deciding means for deciding a target total operative pressure for the control cylinders from the difference between the operative pressure of the pressure cylinder detected by the first pressure detector and a predetermined target working pressure to be applied to the workpiece;

working pressure determining means for determining the working pressure acting on the workpiece from the difference between the operative pressure of the pressure cylinder detected by the first pressure detector and a total operative pressure obtained by adding the respective operative pressures of the control cylinder detected by the second pressure detectors, respectively;

comparing means for comparing the working pressure determined by the working pressure determining means and the predetermined target working pressure;

manipulated variable deciding means for deciding manipulated variables respectively for the control cylinders by obtaining the difference between the target total operative pressure decided by the target total operative pressure deciding means and the total operative pressure of the control cylinders, and adding a bias value variable, determined according to a result of the comparing operation of the comparing means, to values obtained on the basis of the difference between the target total operative pressure and the total operative pressure of the control cylinders and the respective operative pressures of the control cylinders; and control means for controlling the pressure in the control cylinders according to the manipulated variables decided by the manipulated variable deciding means.

* * * * *